US006941922B2

(12) United States Patent
Williams et al.

(10) Patent No.: US 6,941,922 B2
(45) Date of Patent: Sep. 13, 2005

(54) ENGINE LUBRICATION SYSTEM

(75) Inventors: David John Williams, Hampton-on-the-Hill (GB); David Thomas Black, Birmingham (GB)

(73) Assignee: Dana Automotive Limited, Birmingham (GB)

( * ) Notice: Subject to any disclaimer, the term of this patent is extended or adjusted under 35 U.S.C. 154(b) by 198 days.

(21) Appl. No.: 10/437,319

(22) Filed: May 13, 2003

(65) Prior Publication Data

US 2003/0230274 A1 Dec. 18, 2003

(30) Foreign Application Priority Data

May 15, 2002 (GB) ..... 0211110

(51) Int. Cl.[7] ..... F01M 1/00

(52) U.S. Cl. ..... 123/196 R; 123/196 S; 184/6.8; 184/6.22; 184/6.28

(58) Field of Search ..... 123/196 R, 196 A, 123/196 S, 196 AB; 184/6.3, 6.8, 6.21, 6.22, 6.28

(56) References Cited

U.S. PATENT DOCUMENTS

| | | | | |
|---|---|---|---|---|
| 4,424,665 A | | 1/1984 | Guest et al. | |
| 4,531,485 A | * | 7/1985 | Murther | 123/196 S |
| 4,626,344 A | * | 12/1986 | Fick et al. | 210/90 |
| 4,629,033 A | | 12/1986 | Moore et al. | |
| 4,685,066 A | | 8/1987 | Hafele et al. | |
| 5,315,825 A | | 5/1994 | Giberson | |
| 5,351,664 A | * | 10/1994 | Rotter et al. | 123/196 AB |
| 5,682,851 A | | 11/1997 | Breen et al. | |
| 6,213,080 B1 | | 4/2001 | Marsh et al. | |
| 6,644,262 B2 | * | 11/2003 | Matsuda et al. | 123/196 R |
| 6,739,305 B2 | * | 5/2004 | Takahara et al. | 123/196 R |

FOREIGN PATENT DOCUMENTS

| | | |
|---|---|---|
| DE | 39 29 078 A | 3/1991 |
| EP | 0303938 A | 2/1989 |
| EP | 0408758 A | 1/1991 |
| EP | 0500487 A | 8/1992 |
| EP | 1172586 A | 1/2001 |
| GB | 1 553 885 | 10/1979 |
| JP | 57 070907 A | 5/1982 |
| JP | 06 200721 A | 7/1994 |
| JP | 2001 241313 A | 9/2001 |

* cited by examiner

*Primary Examiner*—Noah P. Kamen
(74) *Attorney, Agent, or Firm*—Dykema Gossett PLLC

(57) ABSTRACT

A lubrication system for an engine including a sump for lubricant, a main pump operable to pump lubricant to first lubrication positions within the engine, and an auxiliary lubricant pump also operable to pump lubricant to second lubrication positions within the engine and wherein the auxiliary pump is an electrically driven pump which is controlled by a system controller the output of the auxiliary pump being controlled according to engine operating conditions, the main pump in use, pumping lubricant to the first lubrication positions within the engine along a main lubricant feed line, and the auxiliary pump when operated pumping lubricant to the second lubrication positions within the engine along an auxiliary feed line, and wherein the main and auxiliary feed lines, are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions.

24 Claims, 2 Drawing Sheets

ENGINE LUBRICATION SYSTEM

ENGINE LUBRICATION SYSTEM

This application claims priority to United Kingdom Patent Application No. 0211110.2 filed May 15, 2002, the entire disclosure of which is incorporated herein by reference.

1. Background to the Invention

This invention relates to an engine lubrication system and to a method of operating such a system.

2. Description of the Prior Art

Conventionally engine lubrication systems include a mechanically driven lubrication pump, the output of which is solely dependent upon the engine speed. In steady conditions and at lower engine speeds such mechanical pumps work well and efficiently. However at higher engine speeds, such mechanical pumps tend to pump lubricant in excess of that which is required for lubrication, making them inefficient, and in non-steady conditions, for example when the engine is operating at low speed under heavy load, it is possible that adequate lubrication will not be provided.

Accordingly it has previously been proposed to utilise an electrically driven lubrication pump, the output of which can be varied intelligently to match engine operating conditions. However a straight replacement of the conventional mechanically driven pump with an electrically driven pump only overcomes some of the deficiencies of using conventional mechanically driven pumps.

SUMMARY OF THE INVENTION

According to one aspect of the invention we provide a lubrication system for an engine including a sump for lubricant, a main pump operable to pump lubricant to first lubrication positions within the engine, and an auxiliary lubricant pump operable to pump lubricant to second lubrication positions within the engine and wherein the auxiliary pump is an electrically driven pump which is controlled by a system controller, the output of the auxiliary pump being controlled according to engine operating conditions, the main pump in use, pumping lubricant to the first lubrication positions within the engine along a main lubricant feed line, and the auxiliary pump when operated pumping lubricant to the second lubrication positions within the engine along an auxiliary feed line, and wherein the main and auxiliary feed lines, are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions.

Thus by providing an auxiliary pump with a variable output, various advantages may be realised. Moreover, prior to engine start-up, the communication valve may be opened so that the auxiliary pump may be operated to pump lubricant to the main gallery via the communication passage to prime the lubrication positions fed by the main gallery, prior to engine startup.

The size of the main pump may be reduced compared to a similar system of similar rating because the main pump does not need to be able to satisfy the maximum possible demand for all engine speeds, as any deficiency may be made up by the auxiliary pump.

Thus the main pump may have a linear output relative to engine speed at least during usual selected engine operating conditions.

Preferably the main pump is mechanically driven from an output member of the engine, such as the engine output shaft or crankshaft.

In the main lubricant feed line there may be provided a main lubricant conditioner, which may include at least one of a lubricant filter and a lubricant cooler, whilst in the auxiliary feed line, an auxiliary lubricant conditioner may be provided.

There may be a main lubricant inlet to the main pump and an auxiliary inlet to the auxiliary pump and a passage connecting the main feed line and the auxiliary inlet, with an isolating valve in the connecting passage. In one position the isolating valve may isolate the auxiliary pump inlet from the main feed line and in another position may provide communication between the main feed line and the auxiliary pump inlet, so that lubricant may be pumped by the main pump into the auxiliary feed line past the auxiliary pump.

Although any suitable isolating valve may be used, the isolating valve may be a 90° two position ball valve.

The engine may be of the kind which includes a main lubricant gallery from which lubricant passes to the first lubrication positions to lubricate bearings of the engine crankshaft, and a head gallery from which lubricant passes to the second lubrication positions to lubricate, and operate in some cases, engine valve operating devices.

In some engines there may be a secondary lubrication gallery from which lubricant passes to lubrication positions to lubricate and cool the undersides of pistons of the engine. In this case, a control valve may be provided which is selectively operated by the lubrication system controller to allow lubricant to flow to the secondary gallery in selected operating conditions.

The sump may include an integral mounting for at least one of the main and auxiliary pumps, and an integral mounting for a lubricant conditioner, to facilitate packaging these, and as desired, other, components, such as the isolating valve where provided, for which an integral mounting may also be provided by the sump.

According to a second aspect of the invention we provide a method of operating a lubrication system for an engine which includes a sump for lubricant, a main pump operable to pump lubricant to first lubrication positions within the engine, and an electrically driven auxiliary lubricant pump operable to pump lubricant to second lubrication positions within the engine, and wherein the main and auxiliary feed lines are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions, the method including, for selected engine operating conditions, operating the main pump with the auxiliary pump inoperative or operating to provide a low level output, and for alternative engine operating conditions operating the auxiliary pump or operating the auxiliary pump to provide a higher pump output.

The method may include operating the main pump with the auxiliary pump inoperative or operative to provide a low level output for engine speeds lower than a predetermined engine speed, and operating the main pump and operating or increasing the output of the auxiliary pump for engine speeds higher than a predetermined engine speed, or alternatively the method may include operating the main pump with the auxiliary pump inoperative or operating to provide a low level output, and upon bringing into operation an additional lubricant-using service, continuing to operate the main pump and operating or increasing the output of the auxiliary pump.

Where the engine is of the kind including a main lubricant gallery from which lubricant passes to the first lubrication positions to lubricate bearings of the engine crankshaft, and a head gallery from which lubricant passes to the second lubrication positions to lubricate and in some cases operate engine valve operating devices, and a secondary lubrication gallery from which lubricant passes to lubrication positions to lubricate and cool the undersides of pistons of the engine, there being a control valve which is selectively operated by the lubrication system controller to allow lubricant to flow to the secondary gallery in selected operating conditions, and the method may include operating the control valve to permit lubricant pumped by the main pump to flow to the secondary gallery, and in alternative selected engine operating conditions operating the control valve to permit lubricant pumped by the auxiliary pump to flow to the secondary gallery.

Where the engine includes a main lubricant gallery from which lubricant passes to the first lubrication positions to lubricate bearings of the engine crankshaft, and a head gallery from which lubricant passes to the, second lubrication positions to lubricate and in some cases operate engine valve operating devices including a variable valve timing device, the method may include operating the main pump with the auxiliary pump inoperative or operating to provide a low output, when the variable valve timing device is inoperative, and when the variable valve timing device is operated, operating the main pump and operating or increasing the output of the auxiliary pump.

In each case, the method may include prior to engine start-up or upon main pump failure, operating the auxiliary pump whilst opening the communication valve to allow the flow of lubricant from the auxiliary feed line to the main feed line, and in normal engine operation, closing the communication valve so that the main feed line is fed with lubricant at least primarily from the main pump.

According to a third aspect of the invention we provide a method of operating a lubrication system according to the first aspect of the invention in the event that the main pump fails including the steps of operating the auxiliary pump to provide a maximum flow of lubricant to the lubrication positions.

If desired the method of the third aspect of the invention may include providing an output for an engine management system to result in restriction of engine performance to below a pre-set level.

According to a fourth aspect of the invention we provide a method of determining the state of blockage of a lubricant filter to which lubricant is supplied from a pump, and in which the filter is provided in a lubricant feed line including the steps of sensing the lubricant pressure in the lubricant feed line either side of the filter, and comparing the pressures, and in the event that the pressure differential exceeds a threshold value providing a warning signal.

According to a fifth aspect of the invention we provide a method of operating a lubrication system for an engine which includes a sump for lubricant, a main pump operable to pump lubricant along a main feed line to first lubrication positions within the engine, and an electrically driven auxiliary lubricant pump operable to pump lubricant along an auxiliary feed line to second lubrication positions within the engine, and wherein the main and auxiliary feed lines are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions, the method including, prior to engine start-up or upon main pump failure, operating the auxiliary pump whilst opening the communication valve to allow the flow of lubricant from the auxiliary feed line to the main feed line, and in normal engine operation, closing the communication valve so that the main feed line is fed with lubricant at least primarily from the main pump.

According to a sixth aspect of the invention we provide an engine with a lubrication system according to the first aspect of the invention.

BRIEF DESCRIPTION OF THE DRAWINGS

An embodiment of the invention will now be described with reference to the accompanying drawings which are illustrative diagrams of a lubrication system in accordance with the present invention.

DESCRIPTION OF THE PREFERRED EMBODIMENTS

Figure 1:
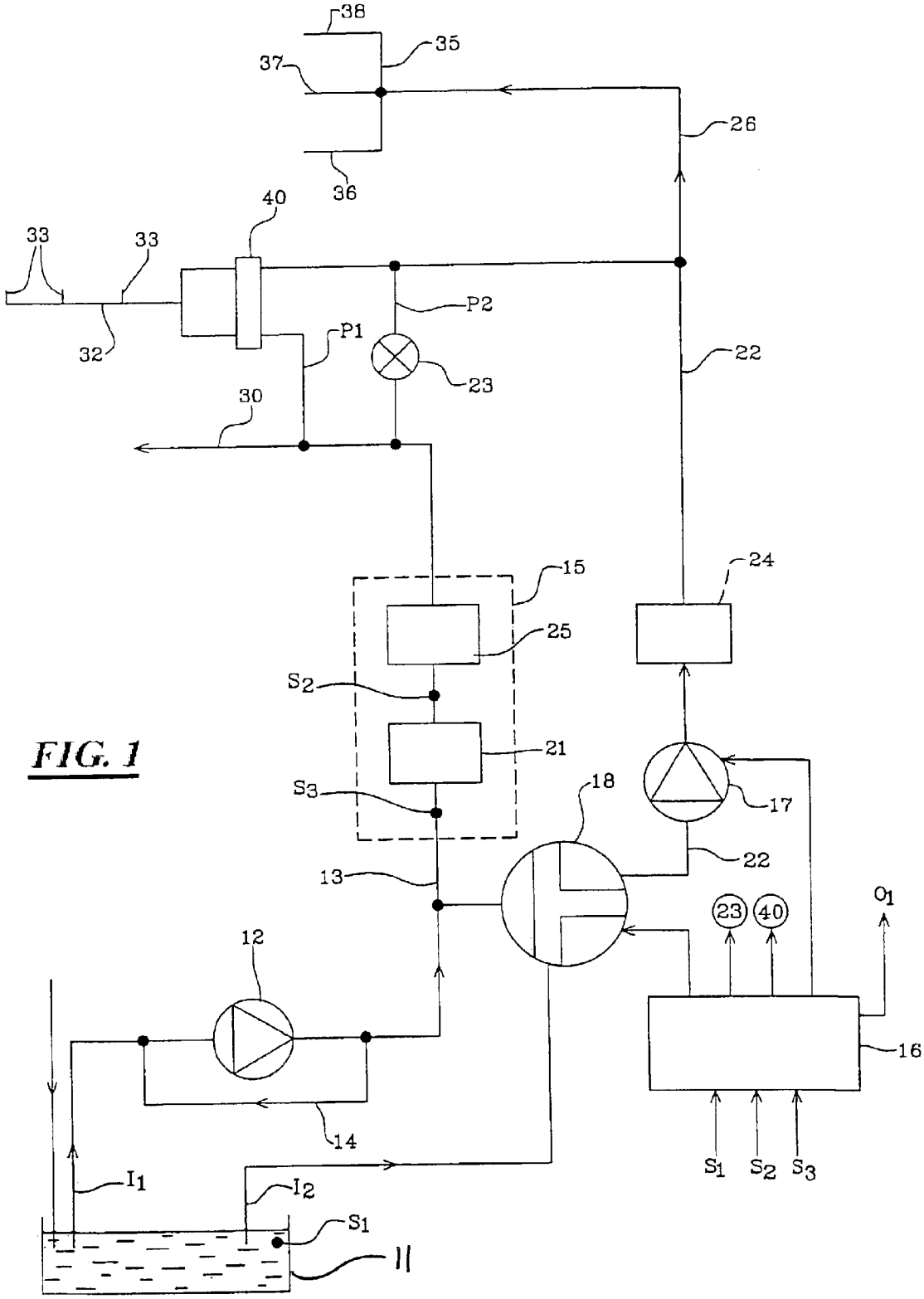
FIG. 1 is an illustrative diagram of a lubrication system in accordance with the present invention.

Referring to the drawing there is shown a lubrication system 10 for an engine. The system 10 includes a sump 11 for lubricant, and a main pump 12 for pumping lubricant from the sump 11 to lubrication positions in the engine.

The main pump 12 in this example is a pump with a linear output relative to engine speed at least over a normal engine speed operating range, and although the main pump 12 may be electrically driven, preferably the pump 12 is mechanically driven from an output member (e.g. crankshaft) of the engine.

The main pump 12 includes a by-pass 14 so that any excess lubricant the pump 12 is constrained to pump e.g. at higher engine speed by virtue of being mechanically coupled to the output member of the engine, can be returned to the sump 11 and thus not used for lubrication. Use of the by-pass 14 in this way represents an inefficiency of operation. A mechanically driven pump in a conventional arrangement must be able to pump enough lubricant at any engine speed to meet the maximum demand for lubricant, but the pumping of excess lubricant unnecessarily increases engine fuel consumption.

In accordance with the invention, the main pump 12 may be of smaller capacity than would be required for a conventional lubrication system of the same rating, because an electrically driven and thus variable output auxiliary pump 17 is provided to provide for at least some lubrication, the auxiliary pump 17 having a variable output as demand requires. Any suitable kind of electrically driven pump 17 may be provided such as for examples only, a gerotor pump, a ring gear pump or a disc pump.

The main pump 12 pumps lubricant along a main feed line 13 to a lubricant conditioner 15 which in this example includes a lubricant filter 21 and a lubricant cooler 25 arranged in-line, but in another example the filter 21 and cooler 25 may be provided in series.

The pumped lubricant from the lubricant conditioner 15 then passes to a main lubrication gallery 30 of the engine from where the lubricant passes to first lubrication positions to lubricate bearings and other components of an engine crankshaft and any turbo charger or other device driven from the engine exhaust gases. The lubricant then passes under gravity back to the sump 11 for further conditioning and recirculation.

The main pump 12 draws lubricant from the sump 11 via a main lubricant inlet $I_1$.

From the main lubricant feed line 13 there is a communication passage $P_1$ in which there is provided a two-way control valve 40. In one position of operation, the control valve 40 permits lubricant to flow along the passage $P_1$ to a secondary lubricant gallery 32 from where the lubricant may pass to lubrication positions 33 at the undersides of pistons of the engine, for the purposes of cooling and lubricating the undersides of the pistons. The control valve 40 is controlled by a lubrication system controller 16.

The main feed line 13 also includes a further communication passage $P_2$ which connects the main feed line 13 with an auxiliary feed line 22, the communication passage $P_2$ including a communication valve 23 which normally is closed, but may be controlled to be opened, by the controller 16, in certain engine operating conditions as will be described below.

The auxiliary pump 17 is also controlled by the controller 16, and the auxiliary pump 17 when operative, draws lubricant from the sump 11 along an auxiliary inlet $I_2$. In another embodiment, instead of the main and auxiliary pumps 12, 17 having separate inlets $I_1$, $I_2$, a combined inlet may be provided.

The auxiliary pump 17 pumps lubricant along an auxiliary lubricant feed line 22 in which there may be provided a further filter 24.

The main 13 and auxiliary 22 feed lines combine to provide a common feed path 26 to a head lubrication gallery 35 having second lubrication positions, for example as shown at 36 to lubricate the engine camshaft (where provided); and at 37 to provide hydraulic pressure and lubrication to hydraulic lash adjusters; and at 38 to provide lubrication for (and in some cases hydraulic pressure to operate) a variable valve timing (VVT) mechanism.

In another example in which the engine is a camless engine, the head gallery 35 may have second lubrication positions for lubricating solenoid operated valves or the like, as desired.

The control valve 40 in the first communication passage $P_1$, when operated in a second position under the control of the controller 16, may permit lubricant from the auxiliary feed line to flow to the secondary gallery 32, whilst preventing the flow of lubricant from the main feed line 13 to the secondary gallery 32, for the purpose described below.

In the auxiliary inlet $I_2$, there is provided an isolating valve 18 which may be operated by the system controller 16, to move between two operating positions. Typically the valve 18 is a two way 90° ball valve, which may be rotated by a valve drive motor under the control of the controller 16. In a first operating position as shown in the drawing, the lubricant may pass along the inlet $I_2$ from the sump 11 to the auxiliary pump 17, but in a second operating position, at 90° to the first operating position for this kind of valve 18, lubricant may also pass from the main inlet Ii to the auxiliary pump 17, as hereinafter described.

A typical method of operating the lubrication system 10 will now be described.

Prior to engine start-up, e.g. when the engine ignition is switched on, engine start-up is deferred until the auxiliary pump 17 is operated for a short period to prime the engine with lubricant. The communication valve 23 in the second communicating passage $P_2$ is opened by the controller 16, and the isolating valve 18 in the auxiliary inlet $I_2$ is moved as necessary to the position shown in the drawing. Thus lubricant will be drawn from the sump 11 through inlet $I_2$ and pumped by the auxiliary pump 17 along the auxiliary feed line 22, into the combined feed path 26, to the head gallery 32 where the lubricant will lubricate the head components and then flow downwardly under gravity back to the sump 11, and via the second communicating passage $P_2$, through communication valve 23, to the main gallery 30 to lubricate the crankshaft etc.

If desired, if a temperature sensor S1 in the sump 11 or elsewhere determines that the lubricant temperature is below a predetermined temperature, say 0° C., prior to operating the auxiliary pump 17, an electrically operated lubricant heater, for example provided in the sump 11 may be operated to heat the lubricant to facilitate the lubricant being pumped and flowing around the lubrication system 10.

A few moments after the auxiliary pump 17 has been operated to prime the engine with lubricant, the engine may be started.

Because the main pump 12 is mechanically driven by the engine, the pump 12 will thus become operative, and then the communication valve 23 in the second communication passage $P_2$ may be closed by the controller 16.

Thus lubricant for the main gallery 30 will be supplied exclusively by the main pump 12, and lubricant for the head gallery 35 will be supplied exclusively by the auxiliary pump 17.

As the engine speed increases, the flow of pumped lubricant to the main gallery 30 will be increased linearly. The controller 16 may increase the output of the auxiliary pump 17 to provide an appropriate increased flow of lubricant to the head gallery 35 too. However upon any increase in demand for lubricant, for example if the VVT mechanism is operated, or increase in the engine load and/or temperature, the controller 16 may increase the output of the auxiliary pump 17 to compensate.

If the controller 16 determines that the undersides of the pistons require lubrication and cooling, for example because the engine speed exceeds a maximum speed and/or the engine load increases and/or the engine temperature increases, the control valve 40 may be operated either to permit lubricant to flow to the secondary gallery 32 from the main feed line 13 and/or the auxiliary feed line 17.

At high engine speeds, the output of the main pump 12 is likely to be sufficient to satisfy the entire demand for lubricant in the engine. In this circumstance, the isolating valve 18 may be rotated by the controller 16 to permit lubricant pumped by the main pump 12 to flow from the main feed line 13, through the auxiliary pump 17, (which may free wheel) into the auxiliary feed line 22 thus to flow to all lubrication positions 30, 33, 36, 37, and 38.

As engine speed decreases, the isolating valve 18 may be moved back to the position shown in the drawing, and the auxiliary pump 17 again operated to pump lubricant.

Upon engine shut-down, the main pump 12 will, because it is mechanically driven from the output member of the engine, cease to operate. However the electrically driven auxiliary lubrication pump 17 may continue to be operated with the communication valve 23 in the second communication passageway $P_2$ open, to permit lubricant to continue to be pumped to the lubrication positions, particularly where a turbocharger is provided which may have a flywheel which may continue to rotate due to inertia, for a considerable time after engine shut-down.

If desired, either side of the filter 21 in the main feed line 13, there may be provided pressure transducers S2 and S3 which together may provide a pressure sensor to give an indication of the extent of blockage of the filter 21. In the event that the pressure differential across the filter 21 exceeds a predetermined threshold, the controller 16 may be arranged to give a warning signal, to indicate to a driver that the filter 21 needs replacement. If desired, such a pressure transducer arrangement may be provided for the filter 24 in the auxiliary feed line 22 also or alternatively.

It will be appreciated that in the event of main pump 12 failure or partial failure, which may be determined from the inputs to the controller 16 from the pressure transducers S2 and S3, the controller 16 may be arranged to open the communication valve 23 in the second communication passageway $P_2$, and to increase the output of the auxiliary pump 17 to a maximum so that lubrication and in some cases, hydraulic pressure to all the lubrication positions may be provided by the auxiliary pump 17. To ensure that the engine is only then operated within operating parameters for which adequate lubrication can be provided by the auxiliary pump 17, the controller 16 may issue a signal $0_1$ e.g. to any engine management system, to restrict the operating conditions to which the engine may perform to below a pre-set level. For example engine speed may be restricted to a low maximum.

When operating in such circumstances, a vehicle in which the engine is provided may be able to continue to be driven e.g. home, so that repairs to the main pump 12 may then be effected.

If desired the lubrication system controller 16 may be an independent assembly, or may be included in part or entirely within the engine management system, or integrally with one of the pumps 12, 17, or with the isolating valve 18.

Figure 2:
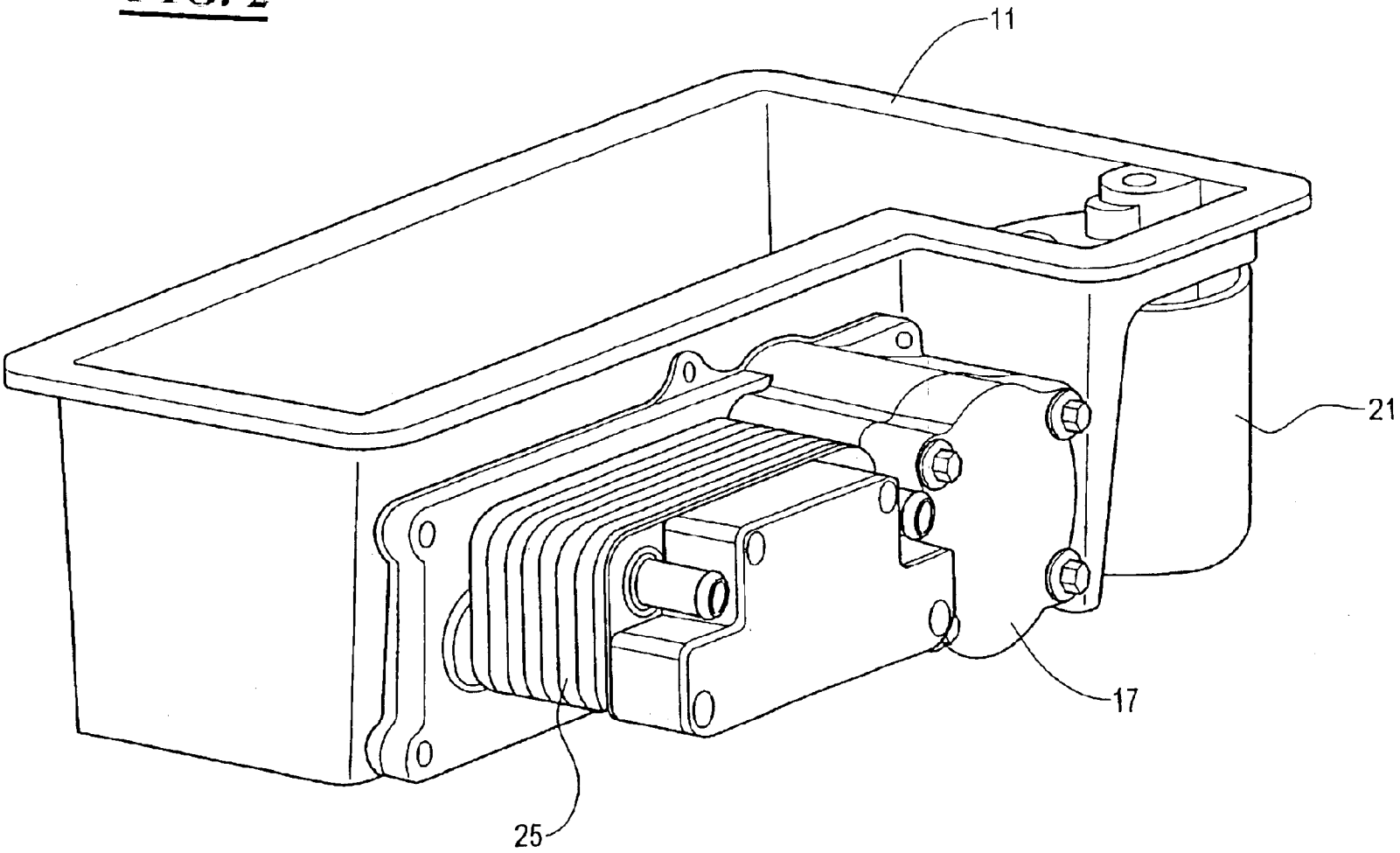
FIG. 2 is a perspective view of a lubrication system in accordance with the present invention.

Preferably the sump 11 is constructed so as to have integral mountings for the auxiliary pump 17 and/or the main pump 12, and/or the isolating valve 18, and/or the lubricant conditioner 15, and/or the lubricant filter 21 in the auxiliary feed line 22, 50 that the major operating components of the lubrication system 10 are conveniently packaged with minimal interconnecting conduits for the lubricant being required. A sump 11 having integral mountings for the auxiliary pump 17, the lubricant cooler 25 and lubricant filter 21 is illustrated in FIG. 2.

The embodiment described is only an example of how the invention may be performed. For example in another engine, under-piston lubrication and cooling may not be required in which case no secondary gallery 32 would be provided. The lubricant conditioner 15 need not include an oil cooler 25 although this is preferred and preferably the lubrication system 10 is coordinated with an engine cooling system to provide for closer control of engine temperature, including lubricant temperature under different engine operating conditions.

In another embodiment, instead of the main pump 12 primarily supplying lubricant to the main gallery 30 and the auxiliary pump 17 to the head gallery 35, the output of both pumps may simply be combined so that the auxiliary pump 17 supplements the output of the main pump 12 as demand requires.

What is claimed is:

1. A lubrication system for an engine including a sump for lubricant, a main pump operable to pump lubricant to first lubrication positions within the engine, and an auxiliary lubricant pump operable to pump lubricant to second lubrication positions, different from said first lubrication positions, within the engine and wherein the auxiliary pump is an electrically driven pump which is controlled by a system controller, the output of the auxiliary pump being controlled according to engine operating conditions, the main pump in use, pumping lubricant to the first lubrication positions within the engine along a main lubricant feed line, and the auxiliary pump when operated pumping lubricant to the second lubrication positions within the engine along an auxiliary feed line, and wherein the main and auxiliary feed lines, are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions.

2. A system according to claim 1 wherein the main pump has a linear output relative to engine speed at least during selected engine operating conditions in which the main pump is operated and the auxiliary pump is inoperative or operating at a low output.

3. A system according to claim 2 wherein the main pump is mechanically driven from an output member of the engine.

4. A system according to claim 1 wherein there is provided a main lubricant conditioner in the main lubricant feed line.

5. A system according to claim 4 wherein the lubricant conditioner includes at least one of a lubricant filter and a lubricant cooler.

6. A system according to claim 1 wherein there is an auxiliary lubricant conditioner in the auxiliary feed line.

7. A system according to claim 1 wherein there is a main lubricant inlet to the main pump and an auxiliary inlet to the auxiliary pump and a passage connecting the main feed line and the auxiliary inlet, an isolating valve in the connecting passage which in one position isolates the auxiliary pump inlet from the main feed line and in another position provides communication between the main feed line and the auxiliary pump inlet.

8. A system according to claim 7 wherein the isolating valve is a 90° two position ball valve.

9. A system according to claim 1 wherein the engine includes a main lubricant gallery from which lubricant passes to the first lubrication positions to lubricate bearings of the engine crankshaft, and a head gallery from which lubricant passes to the second lubrication positions to lubricate engine valve operating devices.

10. A system according to claim 9 wherein the engine includes a secondary lubrication gallery from which lubricant passes to lubrication positions to lubricate and cool the undersides of pistons of the engine.

11. A system according to claim 10 wherein a control valve is provided which is selectively operated by the lubrication system controller to allow lubricant to flow to the secondary lubrication gallery in selected operating conditions.

12. A system according to claim 1 wherein the sump includes an integral mounting for at least one of the main and auxiliary pumps, and an integral mounting for a lubricant conditioner.

13. A system according to claim 12 wherein there is a main lubricant inlet to the main pump and an auxiliary inlet to the auxiliary pump and a passage connecting the main feed line and the auxiliary inlet, an isolating valve in the connecting passage which in one position isolates the auxiliary pump inlet from the main feed line and in another position provides communication between the main feed line and the auxiliary pump inlet and wherein the sump includes an integral mounting for the isolating valve.

14. A method of operating a lubrication system for an engine which includes a sump for lubricant, a main pump operable to pump lubricant along a main feed path to first lubrication positions within the engine, and an electrically driven auxiliary lubricant pump operable to pump lubricant along an auxiliary feed path to second lubrication positions within the engine, and wherein the main and auxiliary feed lines are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions, the method including, for selected engine operating conditions, operating the main pump with the auxiliary pump inoperative or operating to provide a low level output, and for alternative engine operating conditions operating the auxiliary pump or operating auxiliary pump to provide a higher output.

15. A method according to claim 14 which includes operating the main pump with the auxiliary pump inoperative or operative to provide a low level output for engine speeds lower than a predetermined engine speed, and operating the main pump and operating or increasing the output of the auxiliary pump for engine speeds higher than a predetermined engine speed.

16. A method according to claim 14 which includes operating the main pump with the auxiliary pump inoperative or operating to provide a low level output, and upon bringing into operation an additional lubricant-using service, continuing to operate the main pump and operating or increasing the output of the auxiliary pump.

17. A method according to claim 16 wherein the engine includes a main lubricant gallery from which lubricant passes to the first lubrication positions to lubricate bearings of the engine crankshaft, and a head gallery from which lubricant passes to the second lubrication positions to lubricate engine valve operating devices, and a secondary lubrication gallery from which lubricant passes to lubrication positions to lubricate and cool the undersides of pistons of the engine, there being a control valve which is selectively operated by the lubrication system controller to allow lubricant to flow to the secondary gallery in selected operating conditions, the method including operating the control valve to permit lubricant pumped by the main pump to flow to the secondary gallery, and in alternative selected engine operating conditions operating the control valve to permit lubricant pumped by the auxiliary pump to flow to the secondary gallery.

18. A method according to claim 16 wherein the engine includes a main lubricant gallery from which lubricant passes to the first lubrication positions to lubricate bearings of the engine crankshaft, and a head gallery from which lubricant passes to the second lubrication positions to lubricate engine valve operating devices including a variable valve timing device, the method including operating the main pump with the auxiliary pump inoperative or operating to provide a low output, when the variable valve timing device is inoperative, and when the variable valve timing device is operated, operating the main pump and operating or increasing the output of the auxiliary pump.

19. A method according to claim 14 including prior to engine start-up or upon main pump failure, operating the auxiliary pump whilst opening the communication valve to allow the flow of lubricant from the auxiliary feed line to the main feed line, and in normal engine operation, closing the communication valve so that the main feed line is fed with lubricant at least primarily from the main pump.

20. A method of operating a lubrication system for an engine including a sump for lubricant, a main pump operable to pump lubricant to first lubrication positions within the engine, and an auxiliary lubricant pump operable to pump lubricant to second lubrication positions, different from said first lubrication positions, within the engine and wherein the auxiliary pump is an electrically driven pump which is controlled by a system controller, the output of the auxiliary pump being controlled according to engine operating conditions, the main pump in use, pumping lubricant to the first lubrication positions within the engine along a main lubricant feed line, and the auxiliary pump when operated pumping lubricant to the second lubrication positions within the engine along an auxiliary feed line, and wherein the main and auxiliary feed lines, are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions, wherein in the event that the main pump fails, operating the auxiliary pump to provide a maximum flow of lubricant to the lubrication positions.

21. A method according to claim 20 which includes providing an output to an engine management system to result in restriction of engine performance to below a pre-set level.

22. The method of claim 20, further including the steps of providing a lubricant filter in one of the main lubricant feed line and the auxiliary feed line; sensing the lubricant pressure in the one lubricant feed line on either side of the filter, and comparing the pressures, and in the event that the pressure differential exceeds a threshold value providing a warning signal.

23. A method of operating a lubrication system for an engine which includes a sump for lubricant, a main pump operable to pump lubricant along a main feed line to first lubrication positions within the engine, and an electrically driven auxiliary lubricant pump operable to pump lubricant along an auxiliary feed line to second lubrication positions, different from said first lubrication positions, within the engine, and wherein the main and auxiliary feed lines are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions, the method including, prior to engine start-up or upon main pump failure, operating the auxiliary pump whilst opening the communication valve to allow the flow of lubricant from the auxiliary feed line to the main feed line, and in normal engine operation, closing the communication valve so that the main feed line is fed with lubricant at least primarily from the main pump.

24. An engine including a lubrication system including a sump for lubricant, a main pump operable to pump lubricant to first lubrication positions within the engine, and an auxiliary lubricant pump operable to pump lubricant to second lubrication positions, different from said first lubrication positions, within the engine and wherein the auxiliary pump is an electrically driven pump which is controlled by a system controller, the output of the auxiliary pump being controlled according to engine operating conditions, the main pump in use, pumping lubricant to the first lubrication positions within the engine along a main lubricant feed line, and the auxiliary pump when operated pumping lubricant to the second lubrication positions within the engine along an auxiliary feed line, and wherein the main and auxiliary feed lines, are connected via a communication passage which includes a closeable communication valve, the communication valve when closed preventing the flow of lubricant from the auxiliary feed line to the first lubrication positions, and when open permitting the flow of lubricant from the auxiliary feed line to the first lubrication positions.

* * * * *